US005396036A

United States Patent [19]

Yoshida et al.

[11] Patent Number: 5,396,036

[45] Date of Patent: Mar. 7, 1995

[54] ROLLER CONTACT DEVICE

[75] Inventors: Kazuo Yoshida; Yuji Mihara, both of Hyogo, Japan

[73] Assignee: Mitsubishi Denki Kabushiki Kaisha, Tokyo, Japan

[21] Appl. No.: 117,322

[22] Filed: Sep. 7, 1993

[30] Foreign Application Priority Data

Sep. 11, 1992 [JP] Japan ..... 4-269278

[51] Int. Cl.[6] ..... H01H 1/16

[52] U.S. Cl. ..... 200/277; 200/250; 200/290; 200/243

[58] Field of Search ..... 200/277, 250, 240, 243, 200/245, 248, 257, 258, 290

[56] References Cited

U.S. PATENT DOCUMENTS

| | | | |
|---|---|---|---|
| 2,571,794 | 10/1951 | Turner | 200/277 X |
| 3,903,390 | 9/1975 | Cottereau | 200/277 |
| 5,017,744 | 5/1991 | Yoshida | 200/277 |

FOREIGN PATENT DOCUMENTS

| | | | |
|---|---|---|---|
| 1352863 | 1/1964 | France | 200/277 |
| 920732 | 11/1954 | Germany . | |
| 2437637 | 2/1975 | Germany . | |
| 3215109 | 11/1982 | Germany . | |
| 25638 | 6/1977 | Japan . | |
| 52405 | 11/1987 | Japan . | |
| 621067 | 4/1949 | United Kingdom | 200/277 |

*Primary Examiner*—Ernest G. Cusick

*Attorney, Agent, or Firm*—Sughrue, Mion, Zinn, Macpeak & Seas

[57] ABSTRACT

Disposed before and behind stationary contacts 6U and 6L are one pair each of roller contacts 5FM and 5FH, and 5BM and 5BH which are supported collectively at the upper and lower ends thereof by bridge links 4FU and 4FL, and 4BU and 4BL. These paired upper and lower bridge links are then supported by either of support shafts 3F and 3B respectively. The support shafts 3F and 3B for these two pairs of roller contacts and bridge links are supported by a pair of guide shafts 2U and 2L. The guide shafts are loosely engaged with a drive arm 1 and contacting pressure springs 7U and 7L are fitted between the two support shafts.

5 Claims, 5 Drawing Sheets

ROLLER CONTACT DEVICE

BACKGROUND OF THE INVENTION

1. Field of the Invention

This invention relates to a roller contact device suitable for use in a tap changer or the like, and more particularly to an improved roller contact device in which a plural number of pairs of roller contacts are bridged to contact (bridge-contact) with a pair of stationary contacts, so-called a bridge-type roller contact is used.

2. Description of the Prior Art

It is known in a conventional roller contact device using a bridge-type roller contact that an electric current path from a stationary contact, i.e. a first stationary contact to the other stationary contact, i.e. a second stationary contact flows in the following order:

a first stationary contact;

a point of contact of the first stationary contact with a roller contact;

the roller contact;

a point of contact of the roller contact with the second stationary contact;

the second stationary contact. The current path is made by interposing only the roller contact between the two stationary contacts. In other words, since there no interpositions in the current path except for the roller contact (e.g., a roller shaft for rotatably supporting the roller contact, or slidably contacting portions including bearings fitted between the roller contact and the roller shaft), it has the excellent features that electrolytic corrosion does not occur at the slidably contacting portions, and the roller contact can always be maintained in a smooth rotating status.

Now, in a case where an increased current capacity is required for such a roller contact device, it has been suggested that a plural number of roller contacts are arranged in parallel.

Referring to FIG. 8, there is shown an example of the conventional roller contact device of this type in which two roller contacts 5F and 5B are disposed before and behind a first and second stationary contacts 6U and 6L.

In the drawing, the two roller contacts are inserted in parallel in a current path from the first stationary contact to the second stationary contact. Therefore, a current capacity will be redoubled compared with a case where one roller contact is inserted in the current path. Further, it is also suggested in this conventional device that when the current capacity is required to be further increased, two more roller contacts may be disposed in parallel to have a total of four roller contacts and as a result, the current capacity will be further redoubled.

By the way, in case that the four roller contacts (two each) are disposed in parallel before and behind the stationary contacts, a question arises as to how to support them. In the conventional roller contact device, there is only suggested a concrete supporting structure in which two roller contacts are separately arranged. Further, in case the two roller contacts are increased by plural times, there is only suggested a supporting structure in which the structure for supporting the two roller contacts is simply increased by plural times. However, as seen in the conventional suggestions, if the supporting structure for the two roller contacts is simply increased by two times, the device has problems or drawbacks that it requires multiple number of component parts and it is not only uneconomical, but also the overall size must be bulky.

SUMMARY OF THE INVENTION

It is therefore an object of the present invention to solve the problems or drawbacks of the above-described prior art device, and more specifically to provide a roller contact device with a minimum number of component parts and required space which can support and drive four roller contacts disposed before and behind stationary contacts.

According to the present invention, there is provided a roller contact device comprising: a drive arm; a pair of parallel guide shafts each individually and movably supported on the drive arm for back and forth movements; a first support shaft pivotally supported on the fore ends of the guide shafts; a second support shaft loosely engaged with the middle portions of the guide shafts; bridge links rotatably mounted on the upper and lower ends of the first and second support shafts; stationary contacts; two pairs of roller contacts each pair disposed before and behind the stationary contacts and collectively supported at the upper and lower ends thereof by the bridge links; and contacting pressure springs fitted on the guide shafts to apply relatively accessible force between the first and second support shafts.

The roller contact device operates in the manner as follows. In the roller contact device according to the present invention, each pair of the roller contacts disposed before and behind the stationary contacts are supported through the bridge links by one support shaft. Although both support shafts are retained up and down and right and left by guide shafts, they are always coming closer to each other as each support shaft is designed to move individually in back and forth directions and mutually accessible force is applied thereto by the contacting pressure springs. This mutually accessible action by both support shafts results in producing mutually accessible action between each pair of roller contacts disposed before and behind the stationary contacts which are supported by these support shafts and thus a contact engagement of each two roller contacts disposed before and behind the stationary contacts with the stationary contacts interposed therebetween is achieved.

This roller contact device therefore has an advantage over prior art in that one pair each of support shafts, guide shafts and contacting pressure springs are only needed in spite of the provision of two pairs of roller contacts and it is not only economical, but also can be prevented from being large-sized.

The above and other objects, features and advantages of the invention will become more apparent from the following description when taken in conjunction with the accompanying drawings, in which:

DESCRIPTION OF THE PREFERRED EMBODIMENTS

Preferred embodiments of the present invention will be described with reference to the accompanying drawings.

Embodiment 1

Figure 1:
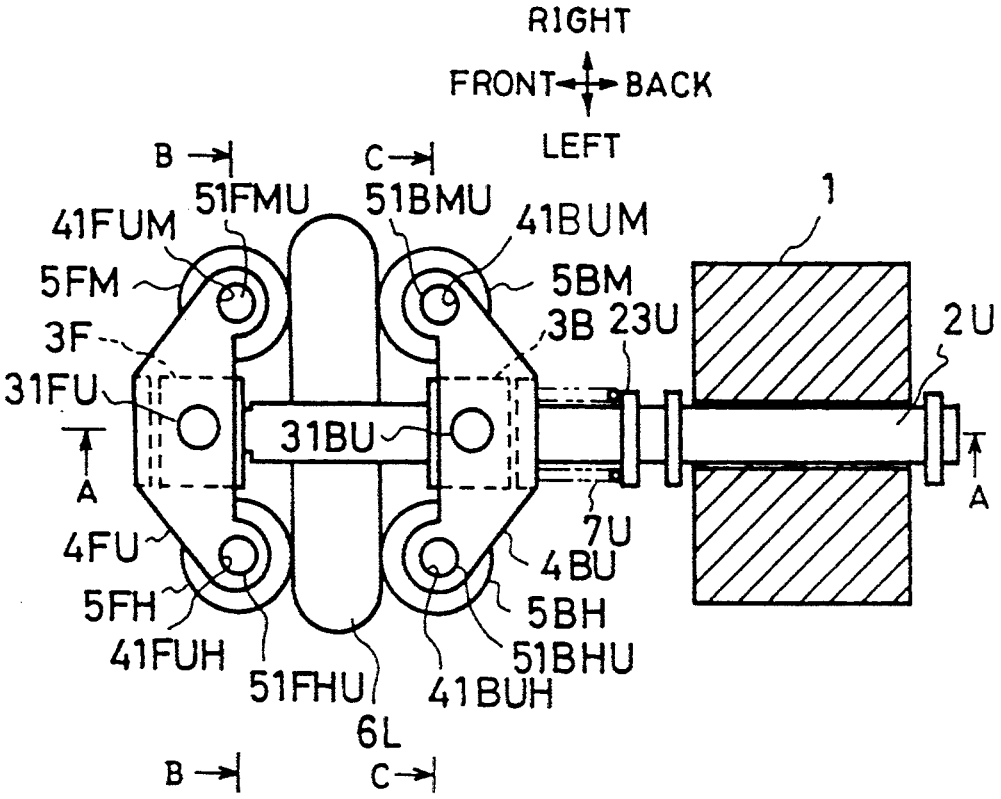
FIG. 1 is a plan view showing a roller contact device according to one embodiment of the present invention.
Figure 2:
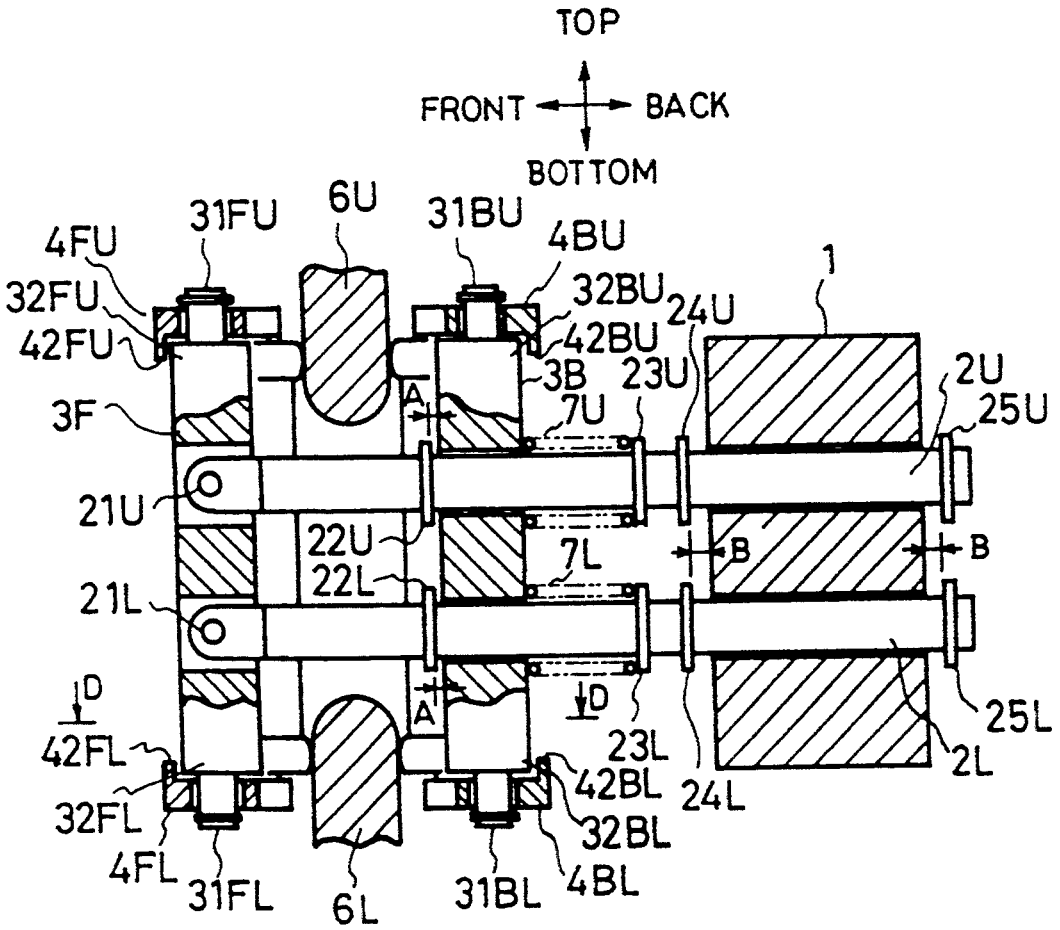
FIG. 2 is a sectional side view taken on line A—A of FIG. 1.
Figure 3:
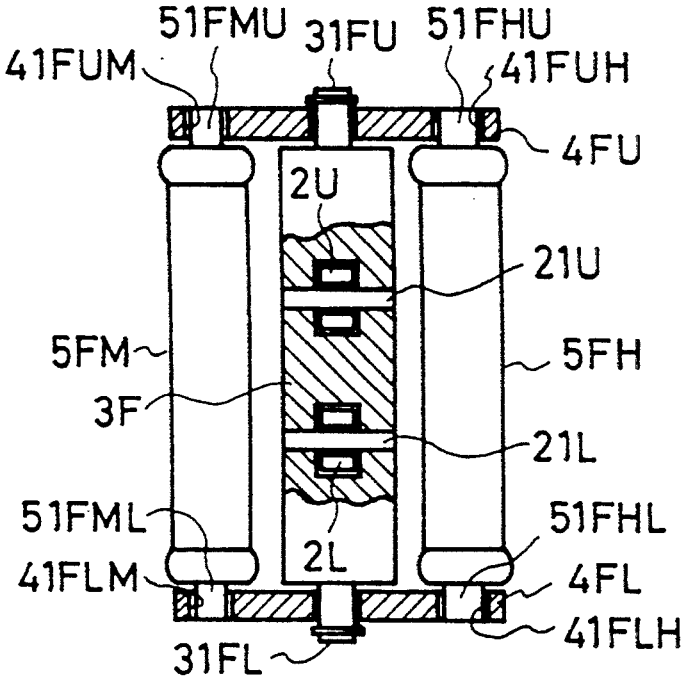
FIG. 3 is a sectional front view taken on line B—B of FIG. 1.
Figure 4:
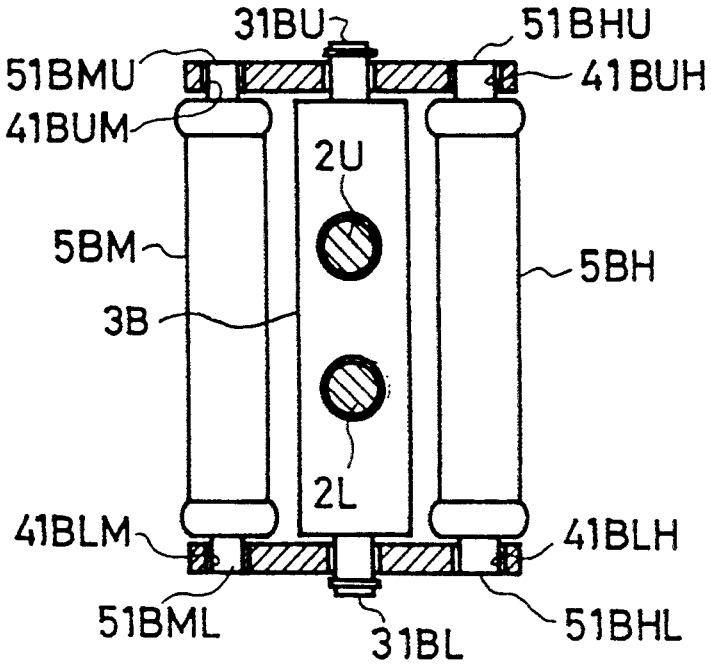
FIG. 4 is a sectional front view taken on line C—C of FIG. 1.
Figure 5:
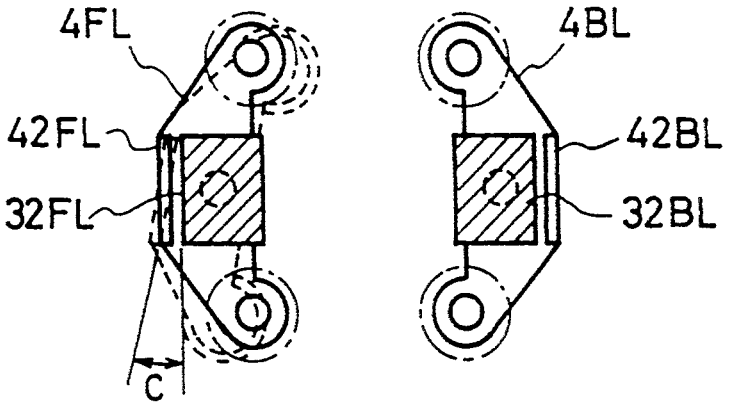
FIG. 5 is a partially sectional plan view taken on line D—D of FIG. 2.

FIG. 1 is a plan view showing a roller contact device according to one embodiment of the present invention and FIG. 2 is a sectional side view taken on line A—A of FIG. 1. FIG. 3 is a sectional front view of the roller contact device taken on line B—B of FIG. 1 and FIG. 4 is also a sectional front view taken on line C—C of FIG. 1. FIG. 5 is a partially sectional view taken on line D—D of FIG. 2. For the explanatory convenience, shown in the drawing by arrows is a definition in each direction, i.e. back and forth, right and left, and up and down of the roller contact device according to the present invention.

In FIGS. 1-5, the drawing, reference numeral 1 is a drive arm movably mounted in right and left directions, and numerals 2U and 2L are a pair of parallel guide shafts loosely engaged at the rear ends thereof with the drive arm 1 to individually move in back and forth directions. Indicated at 3F is a front support shaft pivotably mounted on the fore ends of the guide shafts 2U and 2L by pins 21U and 21L, and at 3B is a rear support shaft loosely engaged with the middle portions of the guide shafts 2U and 2L for movements in back and forth directions. Reference numerals FU and 4FL are a pair of front bridge links rotatably supported at the middle portions thereof by the upper and lower ends 31FU and 31FL of the front support shalt 3F. Numerals 4BU and 4BL are a pair of rear bridge links rotatably supported at the middle portions thereof by the upper and lower ends 31BU and 31BL of the rear support shaft 3B. Denoted at 5FH and 5FM are a pair of front roller contacts loosely engaged at the end portions thereof 51FHU and 51FHL, and 51FMU and 51FML with bearing holes 41FUH and 41FUM, and 41FLH and 41FLM provided in opposite end portions of the front bridge links 4FU and 4FL for free rotation therein, and at 5BH and 5BM are a pair of rear roller contacts loosely engaged at the end portions thereof 51BHU and 51BHL, and 51BMU and 51BML with bearing holes 41BUH and 41BUM, and 41BLH and 41BLM provided in opposite end portions of the rear bridge links 4BU and 4BL for free rotation therein. Reference numerals 6U and 6L are a pair of stationary contacts which are vertically spaced from each other and disposed in parallel between the front roller contacts 5FH and 5FM and the rear roller contacts 5BH and 5BM. Designated at 7U and 7L are contacting pressure springs consisting of pressure springs fitted between spring stoppers 23U and 23L mounted on the guide shafts 2U and 2L and the rear support shaft 3B, and at 22U and 22L are stoppers mounted on the guide shafts 2U and 2L to prevent relatively accessible distance between the front and rear support shafts 3F and 3B from being less than a certain value. Reference numerals 24U and 24L, and 25U and 25L are other stoppers mounted on the rear ends of the guide shafts 2U and 2L to delimit the movements of the glide shafts in back and forth directions, namely to prevent the guide shafts 2U and 2L from coming out of or coming into the drive arm 1. Indicated at 42FU and 42FL, and 42BU and 42BL are stopper projections adapted to delimit relatively rotational angle (i.e. an oscillating angle) of the bridge links 4FU and 4FL, and 4BU and 4BL against the support shafts 3F and 3B to a fixed value.

Stoppers 22U and 22L are disposed in a position where a small amount of clearance A (which, for example, is slightly bigger than a variation due to the production error in the thickness of the stationary contacts 6U and 6L) can be formed between the same and the rear support shafts 3B when all of the roller contacts 5FH and 5FM, and 5BH and 5BM are in the contact closing engagement with the stationary contacts 6U and 6L. Stoppers 24U and 24L, and 25U and 25L are located in a position where a small amount of clearance B (which, for example, is slightly bigger than a variation due to the production error in the thickness and fitting position of the stationary contacts 6U and 6L) can be formed between the same and the drive arm 1 when all of the roller contacts 5FH and 5FM, and 5BH and 5BM are in the contact closing engagement with the stationary contacts 6U and 6L. Stoppers 42FU and 42FL, and 42BU and 42BL are located in a position where a small amount of angular clearance C (which, for example, is slightly bigger than the plane angular oscillation due to the fitting error of the stationary contacts) can be formed against abutting surfaces 2FU, 32FL, 32BU and 32BL provided on the end portions of the support shafts 3F and 3B when all of the roller contacts FH and 5FM, and 5BH and 5BL are in the contact closing engagement with the stationary contacts 6U and 6L.

Pin connecting portions 21U and 21L of the front support shaft 3F to the fore ends of the guide shafts 2U and 2L are provided with some connecting clearances so that the front roller contacts 5FH and 5FM move tiltably following a small amount of thickness or fitting error of the stationary contacts 6U and 6L. Further, The portions where the rear support shaft 3B engages with the guide shafts 2U and 2L are also provided with some engagement clearances to permit such a tilting movement of each roller contact as described above. Still further, the loose engagement portions of upper and lower ends 51FHU, 51FHL, 51FMU, 51FML, 51BHU, 51BHL, 51BMU and 51BML of the roller contacts with bearing holes 41FUH, 41FLH, 41FUM, 41FLM, 41BUH, 41BLM, 41BUM and 41BLM of the bridge links are also provided with some engagement clearances to permit such a tilting movement of the roller contacts as described above.

Next, the operation of the roller contact device according to this Embodiment 1 will be described below. To allow an electric current to flow through the roller contact device, the drive arm 1 is moved in the right and left directions by a certain driving source (not shown in the drawing) until it reaches a position right behind the stationary contacts 6U and 6L and stopped there. FIGS. 1 and 2 show this position, wherein the front and rear roller contacts 5FH and 5FM, and 5BH and 5BM are bridged to connect the two stationary contacts 6U and 6L. Since there are still left clearances between the stoppers 22U and 22L on the guide shafts 2U and 2L and the rear support shaft 3B, between the stoppers 24U and 24L and the drive arm 1, between the stopper projections 42FU and 42FL on the bridge links 4FU and 4FL and the abutting surfaces 32FU and 32FL of the end portions of the front support shaft 3F, and between the stopper projections 42BU and 42BL on the bridge links 4BU and 4BL and the abutting surfaces 32BU and 32BL of the end portions of the rear support shaft 3B, and since these portions have no load-supporting ability, the pressing force of the contacting pressure springs 7U and 7L is transmitted to each contact point between the roller contacts 5FH, 5FM, 5BH and 5BM and the stationary contacts 6U and 6L through the following paths: (A)

rear support shaft 3B;
upper and lower ends thereof 31BU and 31BL;
rear bridge links 4BU and 4BL;
upper and lower ends 51BHU, 51BMU, 51BHL and 51BML of rear roller contacts 5BH and 5BM;

and, (B)

front support shaft 3F;
upper and lower ends thereof 31FU and 31FL;
front bridge links 4FU and 4FL;
upper and lower ends 51FHU, 51FMU, 51FHL and 51FML of the front roller contacts 5FH and 5FM.

An electric current now flows through the contact point contacting with this contacting load (contact pressure) along the following paths:

stationary contact 6U;
roller contacts 5FH, 5FM, 5BH and 5BM;
stationary contact 6L.

To stop the current from flowing through the roller contact device, the drive arm 1 is moved in a direction opposite to above, or may be further moved in the same direction as above. For example, if the drive arm 1 is moved in the right direction, the roller contacts 5FM and 5BM are first disengaged from the stationary contacts 6U and 6L and successively, the roller contacts 5FH and 5BH are disengaged from the latter to open the contacts (i.e. non-current flow condition). After this disengagement, although the front and rear support shafts 3F and 3B, and the front roller contacts 5FH and 5FM and the rear roller contacts 5BH and 5BM supported by the support shafts are urged to come closer to each other by the pressing force of the contacting pressure springs 7U and 7L, this movement is stopped when the rear support shaft 3B comes into abutting engagement with the stoppers 22U and 22L on the guide shafts 2U and 2L. Further, although the bridge links 4FU, 4FL, 4BU and 4BL become rotatable, this rotational movement is stopped when the stopper projections 42FU, 42FL, 42BU and 42BL formed on the bridge links come into abutting engagement with the abutting surfaces 32FU, 32FL, 32BU and 32BL formed on the support shafts. As described above, since the gap spaces A and C of said portions are preset to a small value, such movement after disengagement is also limited to a small amount and therefore, there are maintained suitable gap spaces between the front and rear roller contacts 5FH and 5FM, and 5BH and 5BM to permit an easy reinstallation thereof. In addition, although the guide shafts 2U and 2L are movable back and forth after such disengagement, this movement is stopped when the stoppers 24U and 24L, and 25U and 25L on the guide shafts 2U and 2L come into abutting engagement with the drive arm 1. As described above, since the gap spaces B of said portions are preset to a small value, such movement after disengagement is also limited to the small amount and therefore, each center of the front roller contacts 5FH and 5FM and the rear roller contacts 5BH and 5BM after disengagement and a center of thickness of the stationary contacts 6U and 6L are maintained almost coaxially for easy reinstallation.

Embodiment 2

In the above-described Embodiment 1, the support of the guide shafts by the drive arm is carried out at the rear sides of the guide shafts, but it may be done at two places of rear and front sides of the guide shafts by extending the drive arm in a forward direction. Further, the abutting surfaces against the stoppers delimiting the rotational angle of the bridge links may be provided on the extended portions of the drive arm in place of the provision thereof on the support shafts.

Figure 6:
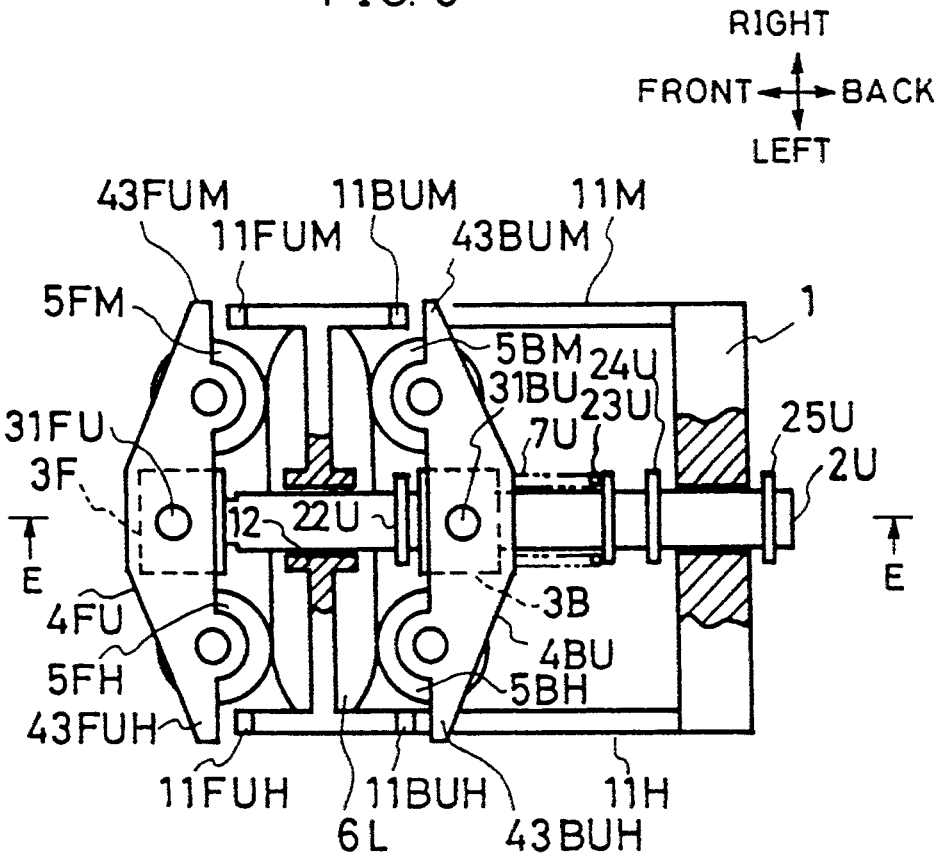
FIG. 6 is a sectional plan view showing a roller contact device according to another embodiment of the present invention.
Figure 7:
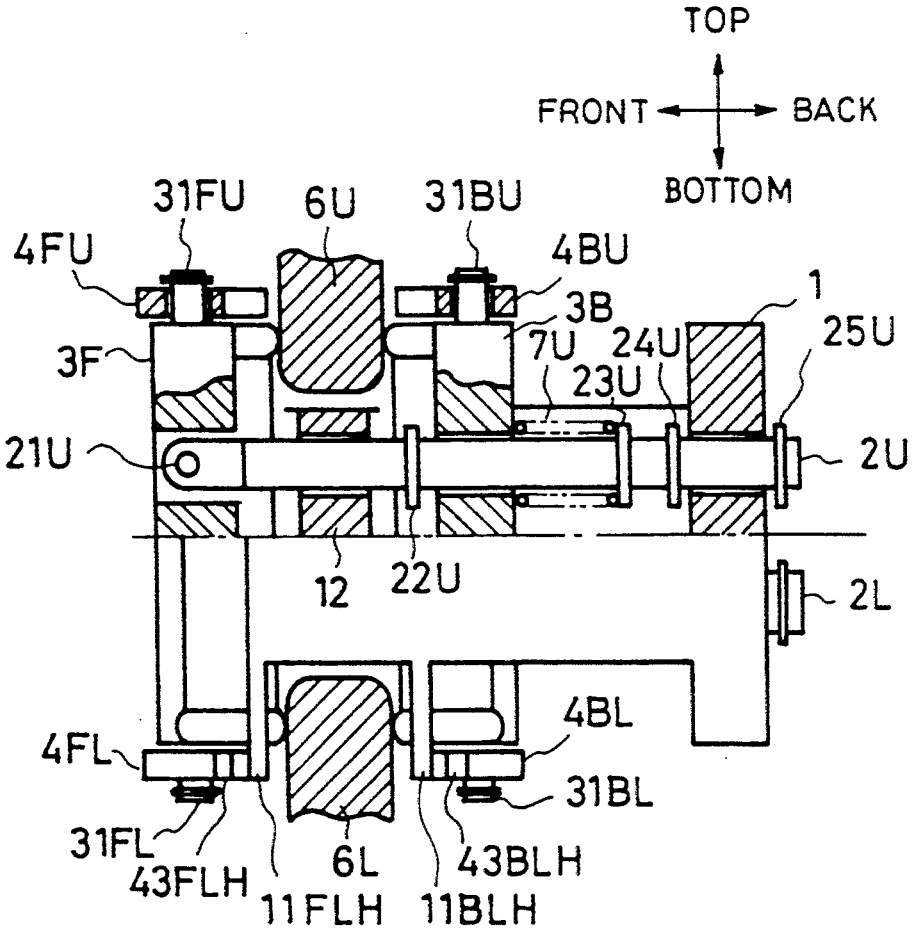
FIG. 7 is a sectional side view taken on line E—E of FIG. 6.
Figure 8:
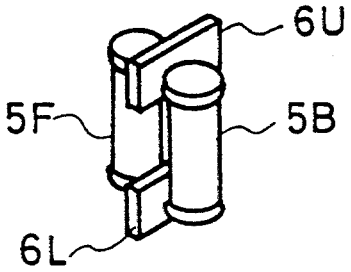
FIG.8 PRIOR ART
FIG. 8 is a perspective view showing a conventional roller contact device.

FIGS. 6 and 7 show this Embodiment 2. FIG. 6 is a plan view showing a roller contact device according to another embodiment of the present invention and FIG. 7 is a sectional side view taken on line E—E of FIG. 6. In the drawings, since components having the same reference numerals as those of FIGS. 1; 5 show that they have the same structure as those of FIGS. 1; 5, a reiterative description is omitted and here is only described the components different from above.

Indicated at 11H and 11M are side arms extended in a forward direction from the right and left ends of the drive arm 1 and at 12 is a front arm extended to said side arms on a line connecting the two stationary contacts 6U and 6L. The guide shafts 2U and 2L are loosely engaged at the front sides therof with the front arm 12 and at the rear sides thereof with the drive arm 1 for back and forth movements. End portions 43FUH and 43FUM, 43FLH and 43FLM, 43BUH and 43BUM, and 43BLH and 43BLM provided on the front bridge links 4FU and 4FL and the rear bridge links 4BU and 4BL respectively are stoppers for delimiting the rotational angle of the front bridge links 4FU and 4FL and the rear bridge links 4BU and 4BL. Reference numerals 11FUH and 11FUM, 11FLH and 11FLM, 11BUH and 11BUM, and 11BLH and 11BLM provided at the upper and lower ends of the side arms 11H and 11M are abutting surfaces located to face said stoppers 43FUH and 43FUM, 43FLH and 43FLM, 43BUH and 43BUM and 43BLH and 43BLM.

Since said stoppers 43FUH, 43FUM, 43FLH and 43FLM and 43BUH, 43BUM, 43BLH and 43BLM, and said abutting surfaces 11FUH, 11FUM, 11FLH and 11FLM, and 11BUH, 11BUM, 11BLH and 11BLM are the substitutions for the stopper projections 42FU, 42FL, 42BU and 42BL and the abutting surfaces 32FU, 32FL, 32BU and 32BL in a case of the Embodiment 1 and since they are also provided to delimit the rotational angle of the bridge links 4FU, 4FL, 4BU and 4BL, the gap spaces between these portions are provided similarly to those of the Embodiment 1.

In the present Embodiment 2, as the basic structure thereof is the same as that of the Embodiment 1, except that a mode of operation in the supporting method of the guide shafts and the method of delimiting the rotational angle of the bridge links is changed and its operation is carried out in the same manner as that of the Embodiment 1, a duplicative description is omitted here.

Embodiment 3

In the Embodiment 2, although the stoppers for delimiting the back and forth movements of the guide shafts are provided before and behind the drive arm in the same manner as the Embodiment 1, they may be also disposed before and behind the front arm.

Embodiment 4

In the above-described Embodiments 1 through 3, although a pair of stationary contacts are vertically spaced from each other, a plural number of pairs of stationary contacts may be arranged in the right and left directions with certain spaces left therebetween, wherein these plural number of pairs of stationary contacts can be successively bridged by moving the drive arm in the right and left directions.

Further, a plural number of pairs of stationary contacts may be located on the circumference having an axis in a vertical direction, in place of locating them in the right and left direction as described above, wherein the drive arm and the roller contacts can be rotated about that axis.

Embodiment 5

Still further, in the above Embodiments 1 through 4, although the vertically spaced pair of stationary contacts are used in a limited but same length, if one side of the stationary contacts can be commonly connected to an electric circuit, that stationary contact may be formed in a continuous or circular shape, so that either side of the upper and lower roller contacts may be located to constantly contact this continuous or circular stationary contact. In this case, since the position of the roller contacts in the back and forth directions is constantly retained by the constant contact thereof with the continuous or circular stationary contact, even if the roller contact is disengaged from the other side of stationary contacts, the guide shafts are prevented from coming out of or coming into the drive arm. It is therefore no more necessary to mount the stoppers for delimiting the guide shafts back and forth movements on the guide shafts.

Embodiment 6

In the above-described Embodiments, the stoppers for delimiting the relative access of the front and rear support shafts are mounted on the guide shafts, but they may be removed, if the contacting surface of the stationary contacts are fully chamfered and the front and rear roller contacts can be reinstalled in position without difficulty, even in such a case where the front and rear roller contacts become in a close contact engagement with each other after their disengagement from the stationary contacts.

It will be appreciated from the foregoing description that the roller contact device according to the present invention is arranged such that one pair each of roller contacts disposed before and behind the stationary contacts are firstly supported collectively by the upper and lower bridge links which are then supported by one piece each of front and rear support shaft, and these front and rear support shafts are supported by a pair of parallel guide shafts which are loosely engaged with the drive arm, and further, the contacting pressure springs are fitted between the front and rear support shafts. As obvious from above, compared with the conventional roller contact device in which each of the front and rear roller contacts is supported by the respective support shafts, the roller contact device according to the present invention contributes to reduce the number of the support shafts, guide shafts and contacting pressure springs to half. It is therefore very effective in that the device is not only economical, but also its overall size can be minimized.

What is claimed is:

1. A roller contact device, comprising: a drive arm;

a pair of parallel guide shafts each loosely engaged with the drive arm and individually and movably supported thereon for back and forth movements;

a front support shaft tiltably pivoted on fore ends of said guide shafts;

a rear support shaft loosely engaged with middle portions of said guide shafts and movably mounted thereon in back and forth directions;

spring supports each provided on rear portions of each of said guide shafts;

a pair of contacting pressure springs each fitted between each of said spring supports and said rear support shaft;

stoppers each provided on each of said guide shafts and adapted to delimit to a predetermined position a forward movement of the rear support shaft by said contacting pressure springs;

a pair of front bridge links loosely engaged 7ith upper and lower ends of said front support shaft at middle portions of said front bridge links and rotatably supported thereon;

a pair of front roller contacts loosely engaged with bearing holes provided in opposite end portions of said front bridge links at upper and lower ends of said front roller contacts and tiltably supported therein;

a pair of rear bridge links loosely engaged with upper and lower ends of said rear support shaft at middle portions of said rear bridge links and rotatably supported thereon;

a pair of rear roller contacts loosely engaged with bearing holes provided in opposite end portions of said rear bridge links at upper and lower ends of said rear roller contacts and tiltably supported therein; and at least a pair of stationary contacts vertically spaced from each other between said rear roller contacts and said paired front roller contacts and adapted to be bridged by said pairs of front and rear roller contacts.

2. A roller contact device, comprising:

a drive arm;

a pair of parallel guide shafts each loosely engaged with the drive arm and individually and movably supported thereon for back and forth movements;

a front support shaft tiltably pivoted on fore ends of these guide shafts;

a rear support shaft loosely engaged with middle portions of said guide shafts and movably mounted thereon in back and forth directions;

spring supports each provided on rear portions /f each of said guide shafts;

a pair of contacting pressure springs fitted between each of said spring supports and said rear support shaft;

stoppers each provided on each of said guide shafts and adapted to delimit to a predetermined position a forward movement of the rear support shaft by said contacting pressure springs;

a pair of front bridge links loosely engaged with upper and lower ends of said front support shaft at middle portions of said front bridge links and rotatably supported thereon;

a pair of front roller contacts loosely engaged with bearing holes provided in opposite end portions of said front bridge links at upper and lower ends of said front roller contacts and tiltably supported therein;

a pair of rear bridge links loosely engaged 7ith the upper and lower ends of said rear support shaft at middle portions of said rear bridge links and rotatably supported thereon;

a pair of rear roller contacts loosely engaged with bearing holes provided in opposite end portions of said rear bridge links at upper and lower ends of said rear roller contacts and tiltably supported therein;

side arms extended in a forward direction from sides of said drive arm;

a front arm extended to the side arms and adapted to support said guide shafts between said front and rear support shafts;

stoppers adapted to contact said side arms and provided to delimit the rotational angle of said front and rear bridge links; and at least a pair of stationary contacts vertically spaced from each other between these paired rear roller contacts and said paired front roller contacts and adapted to be bridged by these two pairs of front and rear roller contacts.

3. A roller contact device according to claim 1, wherein said stoppers are spaced from abutting surfaces provided on end portions of said support shafts so that there are maintained angular clearances therebetween while said roller contacts maintain contact closing engagements with said stationary contacts.

4. A roller contact device according to claim 2, wherein stoppers for delimiting to a predetermined position a forward movement of the rear support shaft by said contacting pressure springs are provided before and behind said front arm.

5. A roller contact device according to claim 1 or 2, wherein 7hen one of said at least a pair of stationary contacts is commonly connected to an electric circuit, said one stationary contact is formed in a continuous or circular shape so that it can constantly contact either of said roller contacts.

* * * * *